US006409539B1

(12) United States Patent
Shi et al.

(10) Patent No.: US 6,409,539 B1
(45) Date of Patent: Jun. 25, 2002

(54) ELECTRICAL CONNECTOR SECURELY MOUNTED ON A PRINTED CIRCUIT BOARD

(75) Inventors: GuangXing Shi; Suiya Wang, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/810,832

(22) Filed: Mar. 16, 2001

(30) Foreign Application Priority Data

Dec. 30, 2000 (TW) ..... 89222912 U

(51) Int. Cl.[7] ..... H01R 13/60
(52) U.S. Cl. ..... 439/567; 439/83
(58) Field of Search ..... 439/83, 567, 607, 439/79

(56) References Cited

U.S. PATENT DOCUMENTS 6,077,118 A * 6/2000 Harada et al. ..... 439/607
6,126,485 A * 10/2000 Shobara et al. ..... 439/607
6,155,878 A * 12/2000 Chen ..... 439/607

* cited by examiner

*Primary Examiner*—Khiem Nguyen
(74) *Attorney, Agent, or Firm*—Wei Te Chung

(57) ABSTRACT

An electrical connector for mounting on a printed circuit board (5) includes an insulating housing (1) with a number of cavities (17) therein, a shield (2) for enclosing the housing, a number of contacts (3) received in the housing, and a pair of bolts (4) for firmly connecting the shield and the housing. A pair of boardlocks (26) and a soldering pad (24) are formed in a bottom of the shield to secure the connector on the printed circuit board. The housing has a front mating face (11) and a bottom surface (12). A pair of resisting pads (14) each includes a retentive portion (141) for securing to the printed circuit board and a vertical portion (142) secured in a recess (19) defined in the bottom surface of the housing.

4 Claims, 5 Drawing Sheets

ELECTRICAL CONNECTOR SECURELY MOUNTED ON A PRINTED CIRCUIT BOARD

BACKGROUND OF THE INVENTION

1. Field of the Invention

The present invention relates to an electrical connector mounted on a printed circuit board (PCB), and particularly to an electrical connector securely mounted on a printed circuit board.

2. Description of the Related Art

Referring to FIG. 1, a conventional electrical connector mounted on a PCB (not shown) comprises an insulating housing 7, a shield 8 and a plurality of contacts 9. The housing 7 forms a mating face 71 in a front thereof with a pair of through holes 75 defined at both sides. A step portion 73 is formed at a rear of the housing 7 and defines two through holes 74 thereon corresponding to the through holes 75 on the mating face 71. At a bottom of the step portion 73 is a bottom surface 72 formed perpendicularly to the mating face 71. A pair of locking means 10 for securing the connector to the PCB each comprises a vertical portion 104 with an aperture 103 thereon, a pair of legs 102 extending parallel to the vertical portion 104, and a connection portion 101 connected therebetween. In assembly, a respective bolt 11 is inserted throughout the aperture 103 of the locking means 10 and the through hole 75 on the mating face 71 and riveted onto the shield 8 to associate the locking means 10 with the housing 7, whereby the legs 102 of the locking means 10 are inserted through the through holes 74 on the step portion 73 and secured in holes of the PCB.

However, during insertion of a mating connector, an inserting force exerted on the connector produces a turning moment on the connector and the legs of the locking means become the pivot point of the turning moment. There is such a long distance between the legs and the mating face of the conventional connector that a small inserting force will lead to a large tuning moment. Subsequently, a resisting moment corresponding to the turning moment is acting on the legs and a longitudinal length of the legs serves as the moment arm. The legs will be subjected to a larger resisting force due to a shorter moment arm of the resisting force. Namely, when the connector is confronted with an operation of inserting/withdrawing a mating connector (not shown) for many times, engagement between parts of the connector may be destroyed and stability of signal transmission cannot be achieved.

Hence, an improved connector for mounting onto a PCB is required to overcome the above-described disadvantages.

SUMMARY OF THE INVENTION

Accordingly, one object of the present invention is to provide an electrical connector which can be firmly secured on a PCB.

To achieve the afore-mentioned object, an electrical connector of the present invention includes an insulating housing with a plurality of cavities therein, a shield for enclosing the housing, a plurality of contacts received in the corresponding cavities, a pair of bolts for connecting the shield and the housing, and a pair of resisting pads. The housing forms a front mating face and a bottom surface. A mating portion extending from the mating face is covered by an enclosing portion of the shield. A pair of boardlocks and a soldering pad are formed at a bottom of the shield for securing the connector on a printed circuit board. The resisting pad includes a retentive portion adapted for securing to the printed circuit board and a vertical portion received in a corresponding recess defined in the bottom surface of the housing. The resisting pads, the soldering pad and the pair of boardlocks of the shield provide an increasing retentive force on the connector comparing to a conventional connector, whereby the connector of the present invention is firmly secured on the PCB.

Other objects, advantages and novel features of the invention will become more apparent from the following detailed description when taken in conjunction with the accompanying drawings.

DETAILED DESCRIPTION OF THE INVENTION

Figure 1:
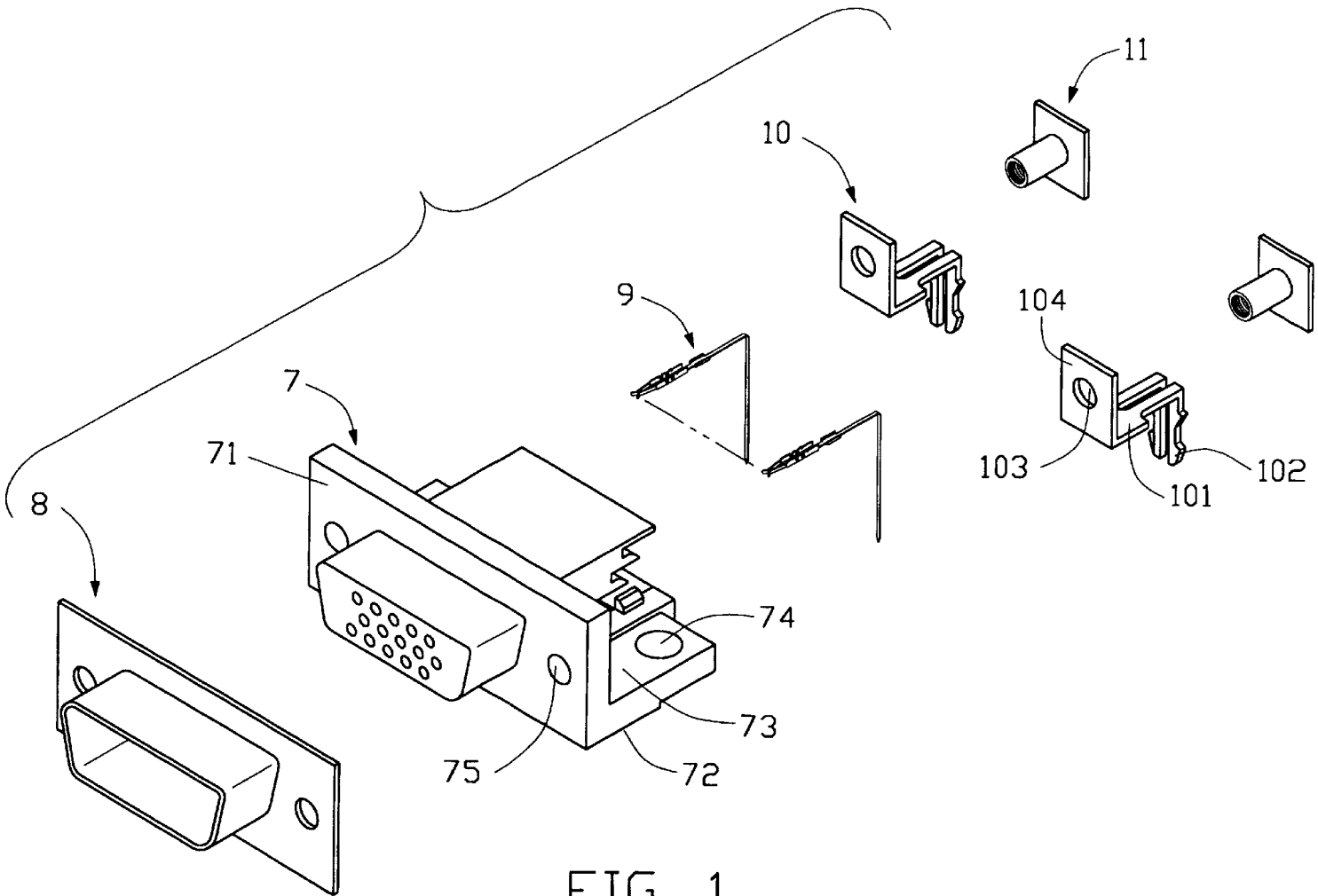
FIG. 1 (PRIOR ART)
FIG. 1 is an exploded perspective view of a conventional electrical connector.

Reference will now be made to the drawing figures to describe the present invention in detail.

Figure 2:
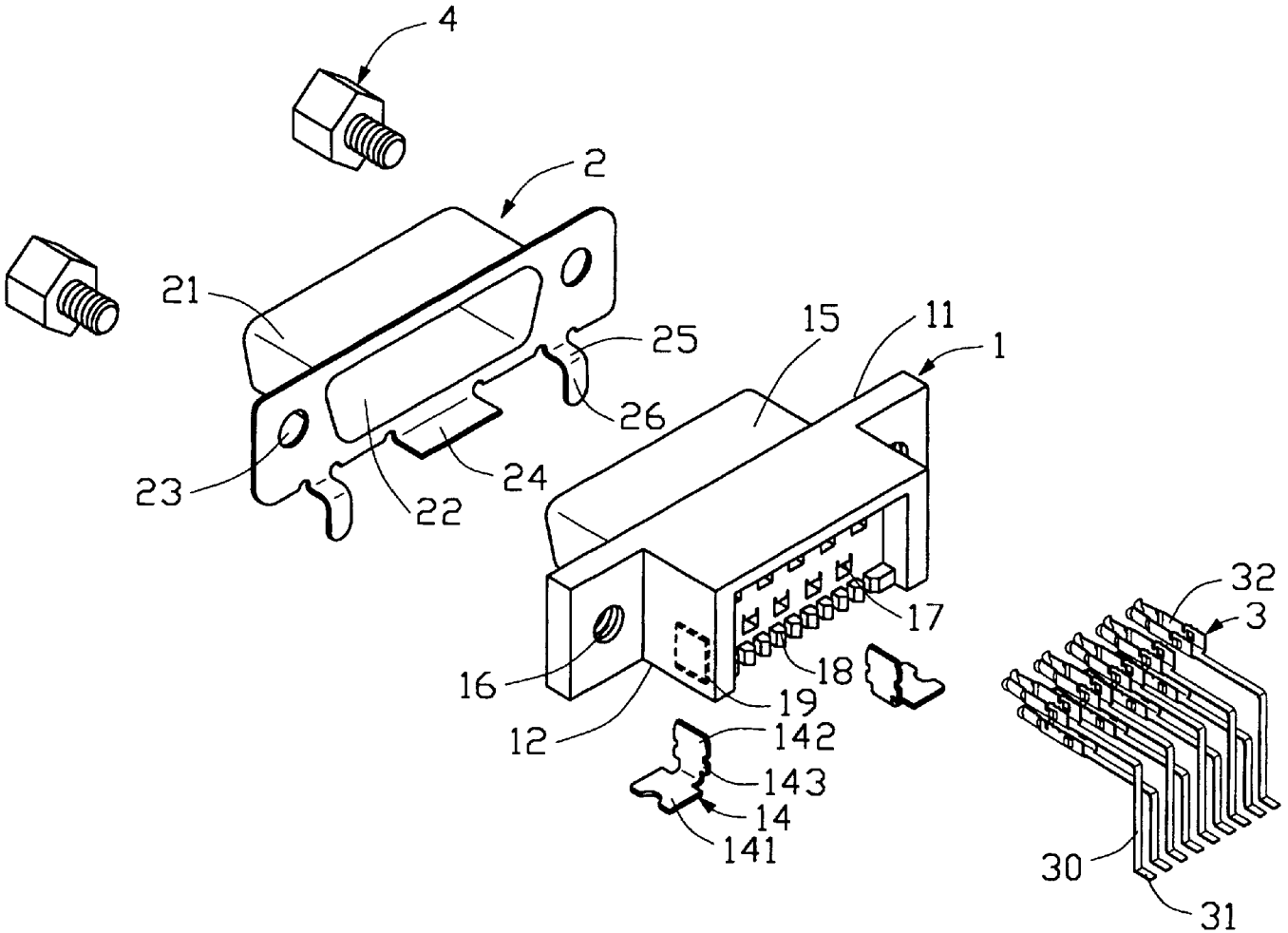
FIG. 2 is an exploded perspective view of an electrical connector in accordance with the present invention.

Referring to FIG. 2, an electrical connector of the present invention comprises an insulating housing 1, a shield 2, a plurality of contacts 3 received in the housing 1, a pair of bolts 4 for associating parts of the connector together, and two resisting pads 14 contained in the housing 1.

Figure 3:
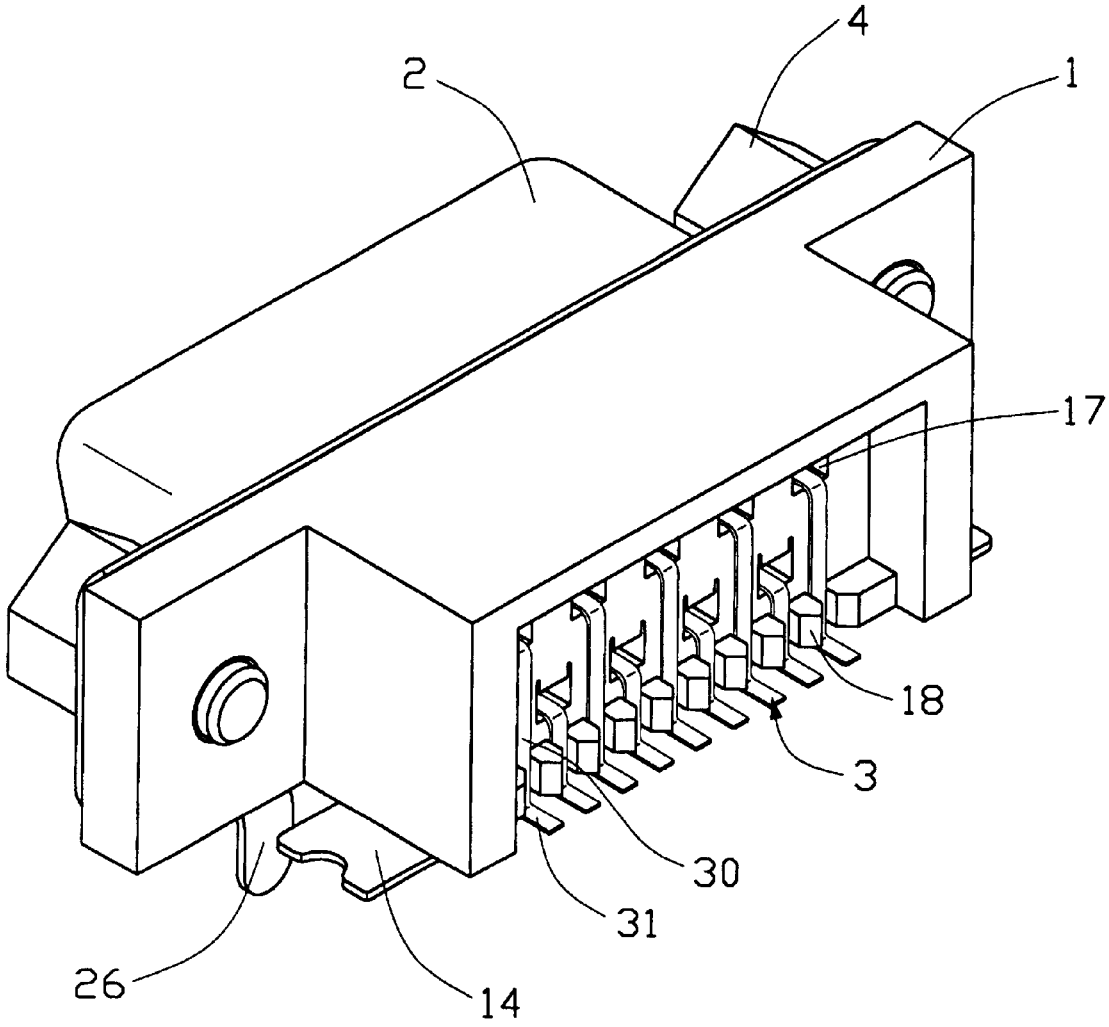
FIG. 3 is an assembled view of FIG. 2.
Figure 4:
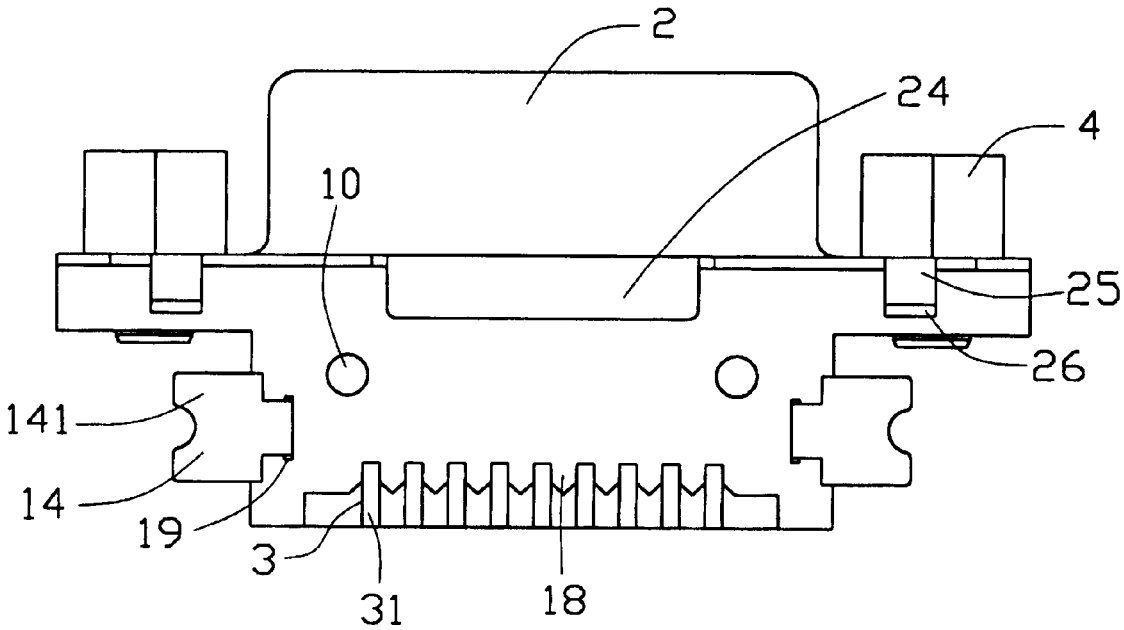
FIG. 4 is a bottom view of the electrical connector in accordance with the present invention.
Figure 5:
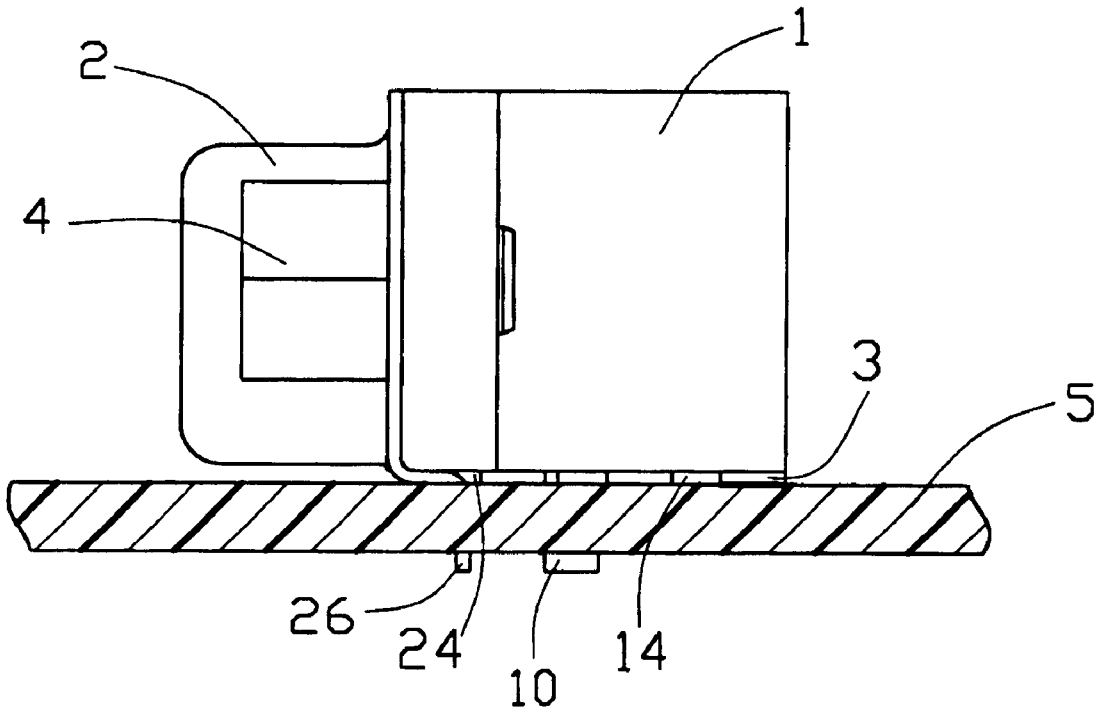
FIG. 5 is a side view showing the electrical connector being mounted on a printed circuit board.

Also referring to FIGS. 3, 4 and 5, the insulating housing 1 provides a front mating face 11 for mating with a complementary connector (not shown) and a D-shaped mating portion 15 extending forwardly from the mating face 11. A pair of screw holes 16 are defined respectively on both sides of the housing 1 for engaging with the bolts 4. A plurality of cavities 17 are defined throughout the housing 1 to contain corresponding contacts 3 therein and a plurality of ribs 18 are interlaced under the cavities 17 at a bottom of the housing 1 to avoid a short circuit between the contacts 3. The housing 1 also forms a bottom surface 12 and a pair of recesses 19 is respectively defined on both edges of the bottom surface 12 for receiving a pair of resisting pads 14 therein. The resisting pad 14 comprises a retentive portion 141 for securing to the PCB 5, a vertical portion 142 extending vertically to the retentive portion 141. A pair of barbs 143 are formed on two edges of the vertical portion 142 for interference fitting with an inner wall of the recess 19. A pair of guiding posts 10 are formed on the bottom surface 12 of the insulating housing 1 for guiding the connector to the PCB 5.

The shield 2 comprises an enclosing portion 21 in a front thereof and a D-shaped hole 22 defined in the enclosing portion 21 for containing the mating portion 15 of the insulating housing 1. A pair of apertures 23 for inserting the bolts 4 therethrough are defined in both ends of a rear of the shield 2. A pair of boardlocks 26 for securing the connector to the PCB 5 are formed in a bottom of the shield 2 and each have a connecting portion 25 extending parallel to the PCB 5. A soldering pad 24 is formed lengthwise in a middle of the two boardlocks 26 to be soldered to the PCB 5. The contact 3 received in the cavity 17 comprises a contacting portion 32, a tail portion 31 and a curved portion 30 connecting the contacting portion 32 and the tail portion 31.

In assembly, firstly, the contacts 3 are respectively accommodated in the corresponding cavities 17. The shield 2 encloses the mating portion 15 and covers the mating face 11, the apertures 23 of the shield 2 are communicating with the screw holes 16 of the housing 1, and the boardlocks 26 are inserted through holes (not shown) of the PCB 5. The vertical portion 142 of each resisting pad 14 is positioned in the corresponding recess 19 and secured therein by the barbs 143 thereof. Then, the pair of bolts 4 are respectively screwed in the aperture 23 and the screw hole 16. Finally, the soldering pad 24 is soldered to the PCB 5 for securing the connector thereon.

The resisting pads 14, the soldering pad 24 and the pair of boardlocks 26 the shield 2 provide an increasing retentive force on the connector comparing to a conventional connector, whereby the connector of the present invention is firmly secured on the PCB 5.

It is to be understood, however, that even though numerous characteristics and advantages of the present invention have been set forth in the foregoing description, together with details of the structure and function of the invention, the disclosure is illustrative only, and changes may bemade in detail, especially in matters of shape, size, and arrangement of parts within the principles of the invention to the full extent indicated by the broad general meaning of the terms in which the appended claims are expressed.

What is claimed is:

1. An electrical connector mounted on a printed circuit board for mating with a mating connector, comprising:

an insulating housing having a front mating face and a bottom surface, the front mating face being adapted to engage a mating connector inserted along a direction parallel to a printed circuit board;

a plurality of contacts received in the insulating housing;

a shield secured to the insulating housing and enclosing the front mating face, the shield having a soldering pad at a bottom, rear edge thereof extending parallel to the printed circuit board and adapted for being secured on the printed circuit board, and a pair of boardlocks formed at the bottom thereof beside the soldering pad for securing the connector to the printed circuit board; and a pair of bolts for connecting the shield and the insulating housing.

2. The electrical connector as described in claim 1, wherein the boardlock has a connecting portion extending parallel to the printed circuit board.

3. An electrical connector assembly comprising:

a printed circuit board with a connector mounted thereon, said connector including:

an insulative housing with a plurality of contacts therein;

a shield secured to the housing, a strip-like soldering pad rearwardly integrally extending along a bottom edge of the shield and soldered on the printed circuit board, and a pair of board locks positioned by two sides of said soldering pad and retainably extending through the printed circuit board, each of said board locks including a horizontal connection portion joined with said bottom edge of the shield; wherein said soldering pad and the horizontal connection portion of each board locks extend parallel to the printed circuit board, and are sandwiched between the printed circuit board and a bottom edge of said housing.

4. The electrical connector as described in claim 2, wherein the soldering pad and the connecting portions of the board locks are sandwiched between the printed circuit board and a bottom edge of the insulating housing.

* * * * *